United States Patent [19]

Varjabedian

[11] Patent Number: 4,549,536

[45] Date of Patent: Oct. 29, 1985

[54] HEADACHE CURING MEDICAL DEVICE

[76] Inventor: Shanoor Varjabedian, 1969 N. Lincoln Park West, Chicago, Ill. 60614

[21] Appl. No.: 533,127

[22] Filed: Sep. 19, 1983

[51] Int. Cl.[4] ..... A61H 39/04

[52] U.S. Cl. ..... 128/60; 128/303 R; 128/329 A

[58] Field of Search ..... 128/354, 329 A, 346, 128/303 R, 59, 60, 61, 67

[56] References Cited

U.S. PATENT DOCUMENTS

| | | | |
|---|---|---|---|
| 2,757,665 | 8/1956 | Tanikawa | 128/346 X |
| 2,959,167 | 11/1960 | Leclabart | 128/59 |
| 3,993,077 | 11/1976 | Kim | 128/329 A |
| 4,320,760 | 3/1982 | Sun et al. | 128/329 A X |
| 4,479,495 | 10/1984 | Isaacson | 128/329 A X |

OTHER PUBLICATIONS

Stillings, Dennis "Acupuncture . . . An Ancient Chinese Method of Healing" *Pulse* p. 16.

*Primary Examiner*—Michael H. Thaler
*Attorney, Agent, or Firm*—Thomas W. Tolpin

[57] ABSTRACT

An effective headache-curing medical device is provided so that the patient need not ingest chemicals contained in headache pills. The medical device has pivotable jaws with a triangular head and a curved seat. In order to cure the patient's headache, the triangular head is pressed against the back of the web of the patient's hand between the patient's thumb and index finger while the seat is pressed against the palm of the patient's hand.

5 Claims, 5 Drawing Figures

HEADACHE CURING MEDICAL DEVICE

BACKGROUND OF THE INVENTION

This invention relates to headaches, and more particularly, to a medical instrument and process for curing headaches.

Headaches are attributable to many factors. Tension, stress, or worry about business or family problems causes headaches. Eye strain, sinuses, colds, and flu can cause headaches. Prolonged over exposure to sun, excessive consumption of alcoholic beverages, loud noises, and high air or water pressures often cause headaches. Headaches can also be caused by fright, fear of death, sight of blood, or loss of a loved one or of one's job. Headaches can occur for several hours or last many days such as migraine headaches.

Over the years a variety of pharmaceutical headache and pain relievers, usually in the form of tablets or pills, have been made available to the public. Some of the more well known pharmaceutical products for relieving headaches are sold under the trade name or trademarks of Aspirin, Bufferin, Excederin, Bayer, Anacin, and Tylenol. These products have met with varying degrees of success.

Many of these pharmaceutical products are not effective in relieving some types of headaches. Furthermore, may of these pharmaceutical products do not relieve the same type of headache in different people. Moreover, patients often build up an immunity to these pharmaceutical products rendering them ineffective. Other patients are allergic to these pharmaceutic products or cannot or do not want to ingest the chemicals in these pharmaceutical products.

It is therefore desirable to provide a medical device and process for curing headaches which overcomes most, if not all, of the above problems.

SUMMARY OF THE INVENTION

An improved medical device and process is provided for curing headaches which is applied to the exterior of a patient's body so that the patient need not ingest chemicals contained in common headache pills, tablets, and other pharmaceutical products. The medical device can be used by physicians, nurses, patients and others who are familiar with the proper procedures and techniques for using the headache curing medical device. Desirably, the novel medical device is effective, safe, and easy to use. Advantageously, the headache curing medical device is compact, lightweight, and portable, and can be readily carried in a purse, briefcase, pocket, or key chain, or conveniently stored in a drawer, a physician's bag, or in other places.

The compact medical device has pivotable jaws which provide top and bottom clamping members. Each clamping member has a pivot arm and an end portion about which the arm pivots. The top clamping member has a head with a downwardly extending apex. The head is preferably pyramid-shaped or cone-shaped to rapidly transmit, consolidate, intensely concentrate, and pin point manually exerted compressive forces on particular nerves of the patient's hand. The bottom clamping member has an elongated palm-engaging seat for uniformly distributing the compressive forces along an engagement region of the patient's palm. Desirably, the tip of the apex and the top surface of the seat are rounded to prevent punctures, abrasions, lacerations, or other injuries to the patient's hand.

In use, the jaws pivot open to comfortably receive the web of the patient's hand between the patient's thumb and index finger and the head and seat are aligned with the back of the web and the palm of the patient's hand, respectively. The jaws are then squeezed so that the apex of the head compresses against the back of the web and the seat abuttingly compresses the palm. Compression is continued for a sufficient period of time to cure the patient's headache. The applied compression may be uniformly applied, or applied with progressively greater compressive forces, or applied intermittently or in pulses. For some patients, it is desirable to sequentially or alternately apply the medical device to both of the patient's hands.

In the preferred procedure, the apex of the head compressively engages the back of the web near the middle of the radial side of the patient's second metacarpal bone or adjacent the intersection of the metacarpals of the patient's thumb and index finger. Most preferably, the apex and seat compressibely engage the patient's hand adjacent the patient's dorsal digital and median nerves in proximity to the patient's thenar muscles and palmer aponeurosis.

A more detailed explanation of the invention is provided in the following description and appended claims taken in conjunction with the accompanying drawings.

DETAILED DESCRIPTION OF THE PREFERRED EMBODIMENT

Figure 2:
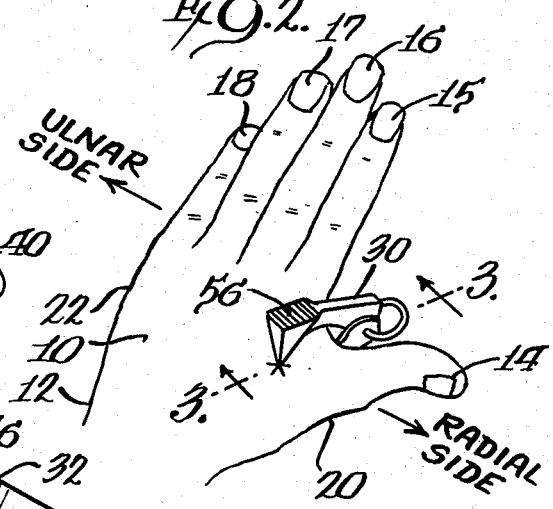
FIG. 2 is a perspective view of the medical device engaging a patient's hand.

In order to best understand and appreciate the invention, it is best to first have a basic understanding of the physiological components of the hand. As shown in FIG. 2, the hand 10 is a limb at the distal end of the forearm. The dorsum or back of the hand extends from the back of the wrist to the tips of the fingers 14–18. The palm or front of the hand extends from the distal crease at the wrist to the tips of the fingers.

The fingers are referred to as digits, the bones of which comprise phalanges. Each of the fingers has distal, middle, and proximal phalanges. The fingers include the thumb 14, the index finger 15, the middle finger 16, the ring finger 17, and the little finger 18. The central part of the hand contains five metacarpal bones which are connected to the phalanges. The wrist contains eight carpal bones which are connected to the metacarpal bones.

The superficial fascia of the dorsum or back of the hand contains cutaneous veins including dorsal digital and metacarpal veins. The dorsal venous arch receives the dorsal metacarpal veins. The radial and ulnar ends of the dorsal venous arch are continuous with the cephalic and basilic veins. The term "radial" as used throughout this application refers to a direction generally inwardly, towards the thumb or center of the body. The term "ulnar" as used throughout this application refers to a direction generally outwardly, away from the thumb or center of the body.

The cutaneous nerves of the dorsum (back of the hand) includes the superficial branch of the radial nerve and the dorsal branch of the ulnar nerve. The superficial branch of the radial nerve extends from the distal third of the forearm to the proximal phalanges of the first 3½ digits (fingers) and include five dorsal digital nerves: (1) the first digital nerve innervates the skin on the radial (inner) side and the thenar eminence 20 of the thumb; (2) the second digital nerve innervates the skin on the ulnar (outer) side of the thumb; (3) the third digital nerve innervates the skin on the radial side fo the index finger; (4) the fourth digital nerve divides and innervates the skin on the adjacent sides of the index and middle fingers; and (5) the fifth digital nerve joins the ulnar digital nerve and divides and innervates the skin on the adjacent sides of the middle and ring fingers.

The dorsal branch of the ulnar nerve extends from the lower half of the front of the forearm to the proximal phalanges of the last 1½ digits (fingers). The dorsal branch of the ulnar nerve curves around the medial side of the ulna and includes three digital nerves: (1) the first digital nerve innervates the skin on the ulnar side of the little finger; (2) the second digital nerve divides and innervates the skin on the adjacent sides of the little and ring fingers; and (3) the third digital nerve joins the radial neves and divides and innervates the skin on the adjacent sides of the middle and ring fingers. The palmar digital branches of the median and ulnar nerves supply the skin on the back of the middle and distal phalanges.

The fascia is very thin on the back of the hand and envelopes the extensor tendons and their expansions. The fascia is attached medially to the dorsum of the fifth metacarpal bone and laterally to the dorsum of the secon metacarpal bone. The fascia include extensor retinaculum, synovial sheaths and dorsal interosseous fascia. There are six compartments which contain the extensor tendons and their synovial sheaths.

Beneath the extensor tendons within the dorsal interosseous fascia are deep arteries including the radial artery and the dorsal carpal branch. The radial artery extends around the lateral side of the carpus from the wrist to the tendons of the abductor and extensor pollicis longus and brevis muscles and enters the palm. The dorsal carpal arch branches to three dorsal metacarpal arteries and bifurcate into proper dorsal digital arteries which supply the proximal phalangeal area.

The cutaneous nerves of the palm or front of the hand include the palmar cutaneous branches of the ulnar and median nerves and the first dorsal digital branch of the radial nerves. The palmer cutaneous branch of the ulnar nerve extends from the distal third of the forearm to the flexor retinaculum to innervate the skin of the hypothenar eminence 20. The palmar cutaneous branch of the median nerve innervates the skin of the central part of the hand and the medial side of the thenar eminence 20.

The superficial facia of the palm contains a generally flat and square muscle located on its ulnar (outer) side, known as the palmaris brevis. The deep antebracial facia of the front of the hand includes the palmar carpal ligament adjacent the wrist, the flexor retinaculum adjacent the palmar carpal ligament, and the palmar aponeurosis in the middle of the hand. The webs at the root of the fingers are reinforced by transverse fibers known as transverse fasciculi. Septums extend backward from the margins of the palmar aponeurosis to subdivide the hand into thenar (thumb/radial side), hypothenar (little finger/ulnar side), and central compartments.

The thenar compartment includes short muscles of the thumb which are innervated by the recurrent branch of the median nerve. These short thumb muscles include: (1) the abductor pollicis brevis which forms the greater part of the thenar eminence 20; (2) the flexor pollicis brevis which is located medial the abductor muscle; and (3) the opponens pollicis which extends beneath the abductor and flexor pollicis brevises. The superficial palmar branch of the radial artery supplies the thenar muscles.

The hypothenar compartment contains the short muscles of the little finger including the abductor digiti minimi, the flexor digit minimi, and the opponens digit minimi. The short muscles of the little finger are innervated by the deep branch of the ulnar nerve.

The central compartment contains the superficial palmar arch which provides branches to the medial 3½ digits. The superficial palmer arch includes three common palmar digital arteris which extend from the arch past the lumbrical muscles between the flexor tendons to the webs of the fingers. Each of these arteries anastomoses with a palmer metacarpal artery of the deep arch and a distal perforating branch from a dorsal metacarpal artery. The short trunks divide into two proper volar digital arteries which supply the contiguous sides of the fingers. The arteries provide branches to the skin, tendons, and joints of the digits, and to the dorsum of the middle and distal phalanges. The median nerve of the central compartment supplies the radial 3½ digits and ramifies into three common palmar digital nerves. The tendons of the flexor digitorum superficialis pass deep to the flexor retinaculum and into the palm. There each tendon extends into its finger, where it enters a fibrous flexor sheath and divides above the proximal phalanx to allow passage for its corresponding profundus tendon. The tendons of the flexor digitorum profundus are connected to the lumbrical muscles in the palm and extend into the base of each distal phalanx. The lumbrical muscles are four cylindrical muscles which pass between the tendons, deep to the digital vessels and nerves, in front of the deep transverse metacarpal ligament, and on the radial side of the metacarpophalangeal joints where they fan out.

The radial artery enters the palm from the back of the hand and branches into the princeps pollicis artery along the ulnar border of the first metacarpal to both sides of the thumb and the radials indicis artery which extends along the radial side of the index finger. The deep palmar arch is formed by the junction of the terminal portion of the radial artery and the deep branch of the ulnar artery. The deep palmer arch includes three palmar metacarpal arteries, recurrent carpal branches and perforating branches.

The web between the thumb and index finger includes the generally triangular adductor pollicis with an oblique and transverse head which extend from the capitate, bases, and palmar surfaces of the second and third metacarpal bones to the ulnar side of the base of the proximal phalanx of the thumb by a sesamoid-containing tendon. The oblique head is adjacent the junction or intersection of the metacarpals of the thumb and index finger (the first and second metacarpals).

The hand has four dorsal and three palmar interossei muscles. All the interossei muscles are innervated by the deep branch of the ulnar nerve.

The nerves, muscles, arteries, veins, and other components of the hands are connected and controlled by various components in the brain. Headaches eminate and are generated by the brain and can be controlled, relieved, minimized and/ior cured by applying the medical device of the present invention to the hand by the techniques dexcribed in this application.

In accordance with principles of the present invention, a headache-curing acupressor medical device, instrument, or apparatus 30 is provided to prevent and cure headaches. The headache-curing device is effective, efficient and safe. It is lightweight, compact and portable and can be readily stored and carried in a purse, briefcase, key chain, physician's bag, and other places. Advantageously, the medical device is relatively inexpensive to manufacture and easy to use.

Figure 1:
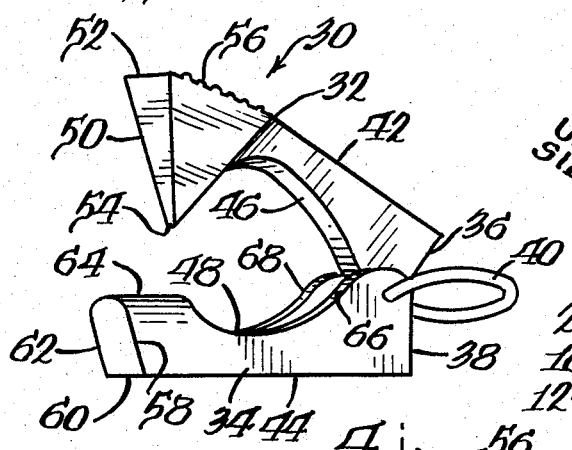
FIG. 1 is a perspective view of a headache curing medical device in accordance with principles of the present invention.

Structurally, the medical device has a pair of elongated, generally rigid jaws or clamping members 32 and 34 (FIG. 1) which are pivotally connected to each other about their end portions 36 and 38 by a connector, such as a pivot pin, or preferably a key ring 40. Each clamping member has a pivot arm 42 or 44 with an inwardly facing concave arcuate surface 46 or 48 and an end portion 36 or 38 about which the arm pivots. The upper and lower concave surfaces 46 and 48 of the pivot arms have a configuration generally complementary to the external shape of the patient's hand between the patient's thumb and index finger and cooperate with each other to define a hand-shaped access opening therebetween for receiving the web of the patient's hand between the patient's thumb and index finger when the jaws are closed to their engaging and clamping position. For sanitary reasons, the medical device is preferably made of medical grade impact-resistant plastic or medical grade metal, such as stainless steel or aluminum, wood, or combinations of these materials.

Figure 3:
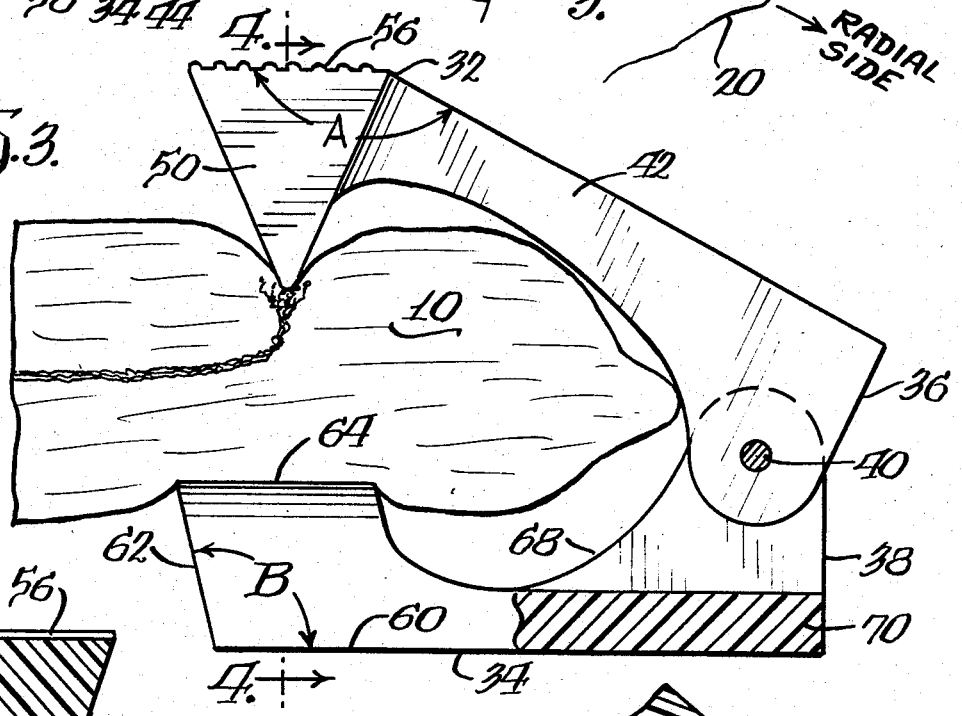
FIG. 3 is an enlarged view of the medical device and patient's hand, shown partly in cross-section, taken substantially along line 3—3 of FIG. 2.
Figure 4:
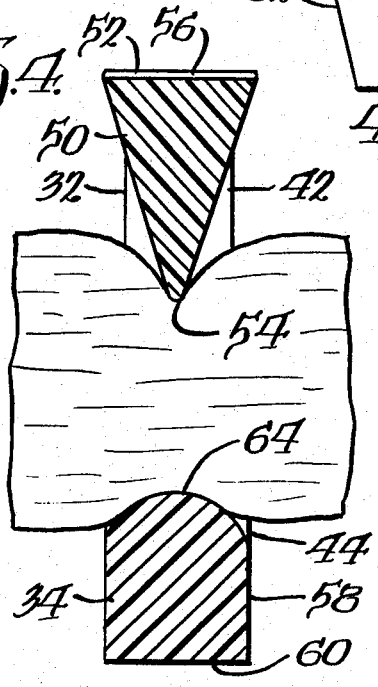
FIG. 4 is a cross-sectional view of the medical device and patient's hand taken substantially along line 4—4 of FIG. 3.

The upper jaw (top clamping member) 32 has an upside down, inverted, generally pyramid-shaped head 50 which is integrally connected and cantilevered from the upper pivot arm 42 along its unattached free end at a location generally opposite the upper pivot end portion 36 of the clamping member. The pyramid-shaped head has a rectangular, manually depressable base 52 at its upper end and a downwardly extending blunted rounded apex 54 at its lower end. The base 52 has upwardly projecting (extending) finger-gripping ribs 56 to enhance gripping of the head. The end of the base is shorter than its side. As best shown in FIG. 3, the top surface of the base of the head is at an obtuse angle A of 100 to 175 degrees, and preferably from 135 to 150 degrees, relative to the top surface of the upper pivot arm 42 to maximize the effective compressive forces exerted on the patient's hand by the apex. The apex 54 (FIG. 1) has a curved or rounded convex tip to prevent puncturing or otherwise injuring the patient's hand. In the illustrated embodiment, the overall height of the head 50 and the upper end portion 36 are each greater than the thickness of the middle portion of the upper pivot arm 42. While the illustrated pyramid-shaped head is preferred for reasons of simplicity and effectiveness, in some circumstances it may be desirable to have a pyramid-shaped head with a triangular base or a polygonal base, or a cone-shaped head or some other shaped head, provided that the head has a blunted curved apex with a rounded tip to prevent puncturing and injuring the patient's hand.

The lower jaw (bottom clamping member) 34 (FIG. 1) has an arcuate palm-engaging seat, heel or pedestal 58 integrally connected and cantilevered from the lower pivot arm 44 along its unattached free end at a location generally opposite the lower end portion 38 of the bottom clamping member. The seat provides a rounded platform that is elongated and generally arch-shaped or n-shaped along its top as viewed from the open free end of the medical device. The sides and bottom of the seat are generally rectangular. The bottom of the seat provides a lower manually depressable base 60. The underlying bottom surface of the base is preferably in coplanar alignment with the bottom surface of the lower pivot arm 44 and can have downwardly projecting finger-gripping ribs to enhance gripping of the base. The slanted flared end wall 62 (FIGS. 2 and 3) are at an oblique angle of inclination B of 95 to 170 degrees, and preferably from 150 to 175 degrees, relative to the bottom surface of the lower pivot arm.

The arch-shaped seat 58 has an upwardly facing, arcuate, rounded engaging portion 64 with a curved top providing a lateral surface that is rounded and convex to prevent puncturing, lacerating or otherwise injuring the patient's hand. In the illustrative embodiment, the overall height of the seat is greater than the thickness of the middle portion of the lower pivot arm 44 but less than the overall height of the lower end portion 38 of the bottom clamping member and the distance from the connector (pivot point) 40 to the apex 54 and center of the seat is about $1\frac{1}{4}$ inches. While the described medical device is preferred for ease of construction, simplicity and effectiveness, generally similarly shaped headache-curing devices having other dimensions and size relationships can be used, if desired. Furthermore, while the illustrated seat is preferred for economy of manufacturing and effectively spreading and distributing the load and pressure on the palm during clamping, a seat having a mushroom-shaped top or a seat having some other shape can be used, provided the upper surface of the seat is rounded to prevent puncturing and injuring the patient's hand.

In the preferred embodiment, the lower pivot arm 44 and the lower end portion 38 has a generally U-shaped cross-section with bifurcated upright walls 66 and 68 (FIG. 1) and a bight or intermediate section 70 (FIG. 3) along its bottom. The intermediate section extends between and separates the upright walls and cooperates with the upright walls to define a pocket and space for slidably receiving a portion of the pivot arm and end portion of the upper clamping member. While this arrangement is preferred for effective distribution of compressive forces, in some circumstances it may be desirable that the upper clamping member be bifurcated or that the lower clamping member comprise a single upright wall.

The jaws pivot from an expanded open inserting position for inserting, removing and storing the medical device to a contracted closed engaging and clamping position for firmly engaging and clamping the patient's hand. The tip or apex of the head is normally spaced from and cooperates with the arch-shaped engaging portion of the seat to provide a mouth or opening therebetween. The mouth spans a distance greater than the thickness of the patient's hand, preferably a maximum of $1\frac{1}{4}$ inches, in the open position, but less than the thickness of the patient's hand in the clamping position.

Figure 5:
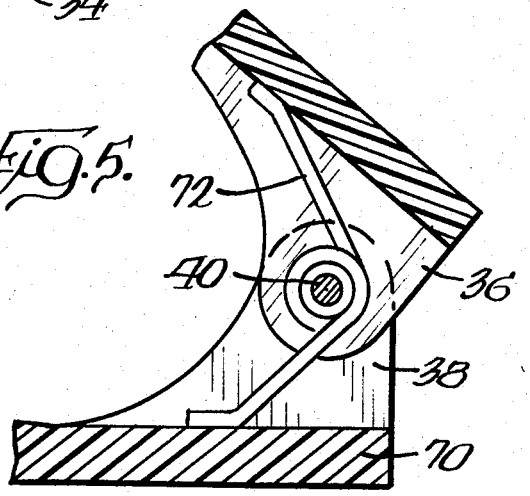
FIG. 5 is a cross-sectional view of a medical device equipped with a spring.

As shown in FIG. 5, a spring 72, such as a tension spring, torsion spring, butterfly spring, coil spring, compression spring, hair spring, or leaf spring, can be placed against the pivot end portions 36 and 38 of the jaws about and/or adjacent the pivot pin (connector) 40 to normally urge and bias the jaws to their expanded open position when not being squeezed by the user. The biasing means can also be in the form of resilient plastic levers or metal fingers. One or more stops or detents can be placed adjacent the pivot end portions of the jaws to limit the extent to which the jaws can close and/or open to a preselected limit.

In use, the top surface of the base of the pyramid-shaped head and the bottom surface of the seat are grasped by the thumb and one or more fingers of the user, respectively. The user's thumb can grasp the head and the user's finger(s) can grasp the seat, or vice versa, as preferred by the user. If desired, the seat can be placed upon a table or other support surface and the head grasped by user's thumb and/or fingers. Prepatory to engaging the patient's hand, the jaws are pivotally spread open (expanded) so that the opening (mouth) between the apex of the head and the convex top surface of the seat is greater than the thickness of the web of the patient's hand between the patient's thumb and index finger. The medical device is then manually oriented so that the web of the patient's hand is positioned between the apex and the seat. Desirably, the patient's thumb and index finger are spread apart at about right angles to each other for maximum access and exposure to the patient's nerves in the web between the patient's thumb and index finger.

The apex of the head is aligned with the back of the patient's hand above (behind) the web and the seat is aligned with the palm or front of the patient's hand below (in front of) the palm or web.

In order to cure the patient's headache, the jaws are manually squeezed and firmly compressed to a contracted closed clamping (engaging) position so that the apex of the head compressively engages the back of the web near the middle of the radial side of the patient's second metacarpal bone (metacarpal bone of the patient's index finger) and the top convex surface of the seat firmly engages and abuttingly contacts the palm of the patient's hand in proximity to the thenar muscles and the palmer aponeurosis. the seat is preferably placed in abutting contact with the palm of the patient's hand before the jaws are compressed (contracted) but can be moved against the palm upon squeezing or in response to compressing the jaws.

An effective technique is to squeeze the jaws so that the apex of the had and the top convex surface of the seat compressively engage and clamp the oblique head of the adductor pollicis (web) of the patient's hand generally adjacent the intersection or junction of the metacarpals of the patient's thumb and index finger. For most effective results, the jaws should be compressed so that the apex of the head and top convex surface of the seat compressively engage and clamp the patient's hand generally adjacent the patient's digital and/or median nerves, preferably in proximity to the patient's flexor pollicis brevis, lumbrical muscle and priceps pollicis artery.

The jaws compress and clamp the patient's hand for a sufficient period of time, typically 5 to 180 seconds, preferably 15 to 30 seconds, to substantially cure the patient's headache. Sufficient compress force and pressure should be exerted on the jaws. Less pressure is usually required when the thumb and index finger are spread apart at about a 90 degree angle to each other. Excessive patient pain and discomfort should be avoided. Clamping the left hand is better than clamping the right hand. For most patients, the jaws should be continually compressed with substantially uniform force and pressure until the headache ceases. For other patients, it is best that the jaws are continually compressed with progressively greater compressive force and pressure until the headache ceases. Still other patients require that the jaws be compressed intermittently or in pulses with varying amounts of pressure until the headache ceases. It is also very effective to sequentially or alternately clamp (engage) each hand of the patient in the manner described previously or simultaneously clamp both hands with two medical devices. The rounded tip of the apex and the rounded top surface of the seat prevent punctures, abrasions, lacerations, and other injuries to the patient when proper compressive force and pressure are applied to the medical device.

Some users prefer to clamp the medical device upon one or both wrists of the patient such as above the styloid process of the patient in proximity to the superficial radial and median nerves. Other users prefer to clamp the medical device to one or both feet along the toe.

The described and illustrated shape and arrangement of the medical device is particularly helpful in locating the apex and seat along the proper nerves of the hand to quickly and efficiently cure the patient's headache.

The medical device may also be helpful to relax facial tension muscles, help cure rashes, and alleviate toothaches and diarrhea.

After the patient's headache has been cured, the jaws of the medical device are pivotally expanded until the apex and seat no longer engage and contact the skin of the patient's hand, i.e. the apex and seat are spaced away from the patient's hand. The medical device is then removed and withdrawn from the patient so that the web of the patient's hand is no longer positioned between the apex of the head and the seat, and the medical device is stored.

Although embodiments of this invention have been shown and described, it is to be understood that various modifications and substitutions, as well as rearrangements of parts and process steps, can be made by those skilled in the art without departing from the novel spirit and scope of this invention.

What is claimed is:

1. A medical device for curing headaches, comprising:

an elongated generally rigid top clamping member having an upper pivot arm with a middle portion and an upper end portion about which said upper arm pivots, said upper pivot arm having a substantially flat top surface and a lower concave surface, said top clamping member having an inverted generally pyramid-shaped head integrally connected and cantilevered from said upper pivot arm generally opposite said upper end portion, said upper end portion and said head each spanning a height greater than the thickness of the middle portion of said upper pivot arm, said pyramid-shaped head having an upper manually depressable base with upwardly extending finger-gripping ribs and a lower downwardly extended blunted apex positioned substantially below said base for firmly engaging a nerve between a patient's thumb and index finger, said blunted apex having a curved rounded tip to substantially prevent injuring the patient's hand;

an elongated generally rigid bottom clamping member having a lower pivot arm with a middle portion and a lower end portion about which said lower arm pivots, said lower pivot arm having a substantially flat bottom surface and an upper concave surface, said bottom clamping member having a palm-engaging seat integrally connected and cantilevered from said lower pivot arm generally opposite said lower end portion, said lower end portion having a greater height than said seat, said lower end portion having a generally U-shaped cross-section defining a pocket for slidably receiving said upper end portion of said upper clamping member, said seat spanning a height greater than the thickness of the middle portion of said lower pivot arm, said palm-engaging seat having a lower manually depressable base and an upper elongated, arcuate engaging portion for firmly engaging the palm of the patient's hand, said arcuate engaging portion having a generally convex top surface to substantially prevent injuring said hand;

connecting means for pivotally connecting said end portions of said top and bottom clamping members;

said connecting means and said clamping members each being of a generally rigid, medical grade material selected from the group consisting esentially of impact resistant plastic, metal, and combinations thereof;

said top and bottom clamping members cooperating with each other to provide pivotable jaws;

said top and bottom clamping members being moveable from an open inserting position for inserting, removing, and storing said medical device to a contracted engaging position for firmly engaging and clamping the patient's hand;

said tip of said head being normally spaced from and cooperating with said arcuate engaging portion of said seat to define a mouth therebetween, said mouth spanning a distance greater than the thickness of the patient's hand in said open inserting position, but less than the thickness of the patient's hand in said contracted engagin position;

said tip of said head being in substantial vertical alignment and registration with said arcuate engaging portion of said seat in said closed engaging position; and said upper and lower concave surfaces of said pivot arms having a configuration generally complementary to the external shape of the patient's hand between the patient's thumb and index finger and cooperating with each other to define an access opening for receiving the web of the patient's hand between the patient's thumb and index finger in said closed engaging position.

2. A medical device for curing headaches, comprising:

an elongated generally rigid top clamping member having an upper pivot arm with a middle portion and a lower concave surface, an upper end portion about which said upper arm pivots, and an inverted generally pyramid-shaped head integrally connected and cantilevered from said upper pivot arm generally opposite said upper end portion, said upper end portion and said head each spanning a height greater than the thickness of the middle portion of said upper pivot arm, said pyramid-shaped head having an upper manually depressable base with upwardly extending finger-gripping ribs and a lower downwardly extending blunted apex positioned substantially below said base for firmly engaging a nerve between a patient's thumb and index finger, said blunted apex having a curve rounded tip to substantially prevent injuring the patient's hand;

an elongated generally rigid bottom clamping member having a lower pivot arm with a middle portion and an upper concave surface, a lower end portion about which said lower arm pivots, and a palm-engaging seat integrally connected and cantilevered from said lower pivot arm generally opposite said lower end portion, said lower end portion having a greater height than said seat, said seat spanning a height greater than the thickness of the middle portion of said lower pivot arm, said palm-engaging seat having a lower manually depressable base and an upper elongated, arcuate engaging portion for firmly engaging the palm of the patient's hand, said arcuate engaging portion having a generally convex top surface to substantially prevent injuring said hand;

connecting means for pivotally connecting said end portions of said top and bottom clamping members;

said connecting means and said clamping members each being of a generally rigid, medical grade material selected from the group consisting essentially of impact resistant plastic, metal, and combinations there;

said top and bottom clamping members cooperating with each other to provide pivotable jaws;

said top and bottom clamping members being moveable from an open inserting position for inserting, removing, and storing said medical device to a contracted engaging postion for firmly engaging and clamping the patient's hand;

said tip of said head being normally spaced from and cooperating with said arcuate engaging portion of said seat to define a mouth therebetween, said mouth spanning a distance greater than the thickness of the patient's hand in said open inserting position, but less than the thickness of the patient's hand in said contacted engaging position;

said tip of said head being in substantial vertical alignment and registration with said arcuate engaging portion of said seat in said closed engaging position;

said upper and lower concave surfaces of said pivot arms cooperating with each other to define an access opening for receiving the web of the patient's hand between the patient's thumb and index finger in said closed engaging position;

said base of said head and said upper pivot arm each having a top surface, said top surfaces of said base and said upper pivot arm being positioned at an obtuse angle of inclination ranging from 100 degrees to 175 degrees; and said seat having a slanted end wall, said lower pivot arm having a bottom surface, and said slanted end wall being positioned at an obtuse angle ranging from 95 degrees to 170 degrees relative to said bottom surface.

3. A medical device in accordance with claim 2 wherein said connecting means comprises a key ring.

4. A medical device in accordance with claim 2 wherein said pivot arm and said end portion of one of said clamping members comprise bifurcated generally upright walls and a bight defining an intermediate section extending between and separating said upright walls.

5. A medical device in accordance with claim 2 including spring means for normally urging said clamping members in said open position.

* * * * *